US009201364B2

(12) United States Patent
Natori et al.

(10) Patent No.: US 9,201,364 B2
(45) Date of Patent: Dec. 1, 2015

(54) ELASTIC MEMBER FOR IMAGE FORMING APPARATUS CONTAINING A BASE AND AN ELASTIC LAYER, AND FIXING MEMBER, FIXING DEVICE, AND IMAGE FORMING APPARATUS

(71) Applicants: Junichiro Natori, Kanagawa (JP); Tsuneaki Kondoh, Kanagawa (JP); Tomoaki Sugawara, Kanagawa (JP)

(72) Inventors: Junichiro Natori, Kanagawa (JP); Tsuneaki Kondoh, Kanagawa (JP); Tomoaki Sugawara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/384,226

(22) PCT Filed: Mar. 28, 2013

(86) PCT No.: PCT/JP2013/060258
§ 371 (c)(1),
(2) Date: Sep. 10, 2014

(87) PCT Pub. No.: WO2013/151109
PCT Pub. Date: Oct. 10, 2013

(65) Prior Publication Data

US 2015/0078794 A1 Mar. 19, 2015

(30) Foreign Application Priority Data

Apr. 2, 2012 (JP) ..... 2012-083684

(51) Int. Cl.
*G03G 15/20* (2006.01)

(52) U.S. Cl.
CPC ..... *G03G 15/206* (2013.01); *G03G 15/2057* (2013.01); *G03G 2215/2029* (2013.01)

(58) Field of Classification Search
CPC ..... G03G 15/2057; G03G 15/2029
USPC ..... 399/333
See application file for complete search history.

(56) References Cited

U.S. PATENT DOCUMENTS

| | | | | |
|---|---|---|---|---|
| 7,558,520 | B2 | 7/2009 | Sugawara et al. | |
| 8,301,068 | B2 | 10/2012 | Kondoh et al. | |
| 2001/0024582 | A1* | 9/2001 | Hwang | 399/333 |
| 2002/0034395 | A1 | 3/2002 | Ohuchi et al. | |
| 2002/0114649 | A1 | 8/2002 | Ohuchi | |
| 2004/0069404 | A1 | 4/2004 | Kondoh | |
| 2004/0224165 | A1 | 11/2004 | Kondoh et al. | |
| 2005/0084690 | A1 | 4/2005 | Matsunaka et al. | |

(Continued)

FOREIGN PATENT DOCUMENTS

| | | |
|---|---|---|
| JP | 08-333433 | 12/1996 |
| JP | 11-119462 | 4/1999 |

(Continued)

OTHER PUBLICATIONS

International Search Report issued on May 14, 2013 in PCT/JP2013/060258 filed on Mar. 28, 2013.

(Continued)

*Primary Examiner* — Billy Lactaoen
(74) *Attorney, Agent, or Firm* — Oblon, McClelland, Maier & Neustadt, L.L.P.

(57) ABSTRACT

To provide an elastic member for image forming apparatus, which contains: a base; and an elastic layer provided on the base, wherein the elastic layer contains a polymer having a structure derived from terpene and a structure where a main chain contains a silicon atom.

7 Claims, 2 Drawing Sheets

(56) References Cited

U.S. PATENT DOCUMENTS

| | | | | |
|---|---|---|---|---|
| 2005/0095381 | A1 | 5/2005 | Kondoh | |
| 2005/0207806 | A1 | 9/2005 | Yoshii et al. | |
| 2005/0220502 | A1* | 10/2005 | Kim | 399/286 |
| 2006/0198666 | A1 | 9/2006 | Kondoh et al. | |
| 2007/0140758 | A1 | 6/2007 | Aze et al. | |
| 2008/0063444 | A1 | 3/2008 | Kondoh et al. | |
| 2009/0003903 | A1 | 1/2009 | Katano et al. | |
| 2009/0263584 | A1 | 10/2009 | Katano et al. | |
| 2010/0129123 | A1 | 5/2010 | Natori et al. | |
| 2010/0135695 | A1* | 6/2010 | Mayuzumi et al. | 399/111 |
| 2011/0013957 | A1 | 1/2011 | Katano et al. | |
| 2012/0322967 | A1 | 12/2012 | Kondoh et al. | |

FOREIGN PATENT DOCUMENTS

| | | |
|---|---|---|
| JP | 2002-040802 | 2/2002 |
| JP | 2002-189341 | 7/2002 |
| JP | 2002-249620 | 9/2002 |
| JP | 2007-086754 | 4/2007 |
| JP | 2009-198788 | 9/2009 |
| JP | 2011-034043 | 2/2011 |
| JP | 2012-047848 | 3/2012 |

OTHER PUBLICATIONS

Extended European Search Report issued Mar. 12, 2015 in Patent Application No. 13771935.7.

* cited by examiner

ELASTIC MEMBER FOR IMAGE FORMING APPARATUS CONTAINING A BASE AND AN ELASTIC LAYER, AND FIXING MEMBER, FIXING DEVICE, AND IMAGE FORMING APPARATUS

TECHNICAL FIELD

The present invention relates to an elastic member for an image forming apparatus, and to a fixing member, a fixing device, and an image forming apparatus.

BACKGROUND ART

An electrophotographic color image forming apparatus, such as a photocopier, and a printer, is equipped with an image forming unit configured to form a color image composed of 4 color toners (cyan, magenta, yellow, and black) on a recording medium, and a fixing unit (fixing device) configured to fox the formed color image onto the recording medium. The fixing device contains a fixing member configured to heat and fix the toner on the recording medium, and a press member that forms a nip with the fixing member. When the recording medium is passed through the nip, the toner is heated and pressurized so that the toner is fixed onto the recording medium to thereby form a color image.

As for the fixing member, typically used is a fixing roller or fixing belt, in which silicone rubber forms an elastic layer that is provided on a base formed of a metal or a resin.

The elastic layer formed only of the silicone rubber has insufficient releasing property, and therefore it may be difficult to release a recording medium, on which the toner has been fixed at the nip, from the fixing member, or jamming of the recording medium tends to occur.

Accordingly, proposed is a fixing device, releasing properties of which is improved by coating a surface of a fixing member with a fluororesin, and further applying or dip coating a releasing agent to the fluororesin-coated fixing member (see PTL 1). Since the outermost surface of the heat roller of the aforementioned fixing device, which is brought into contact with a toner image, is composed of the fluororesin, the fixing member has poor responsiveness to surface irregularities of the recording medium, to thereby form unevenness in image quality of a resulting image.

Moreover, if a rubber having low hardness is used for a fixing member to improve responsiveness, the responsiveness thereof to the irregularities is improved, but the softer rubber results in less durability.

CITATION LIST

Patent Literature

PTL 1: Japanese Patent Application Laid-Open (JP-A) No. 2007-86754

SUMMARY OF INVENTION

Technical Problem

The present invention aims to solve the aforementioned various problems in the art and to achieve the following object. Specifically, an object of the present invention is to provide an elastic member capable of outputting high quality images without any unevenness over a long period because of an improvement thereof in responsiveness to surface irregularity of a recording medium without impairing durability of rubber.

Solution to Problem

Means for solving the aforementioned problems are as follow:

An elastic member for image forming apparatus, containing:

a base; and an elastic layer provided on the base, wherein the elastic layer contains a polymer having a structure derived from terpene and a structure where a main chain contains a silicon atom.

Advantageous Effects of Invention

The present invention can solve the aforementioned various problems in the art, and achieve the aforementioned object. Moreover, the present invention can provide an elastic member capable of outputting high quality images without any unevenness over a long period because of an improvement thereof in responsiveness to surface irregularity of a recording medium without impairing durability of rubber.

DESCRIPTION OF EMBODIMENTS (Elastic Member)

Figure 1:
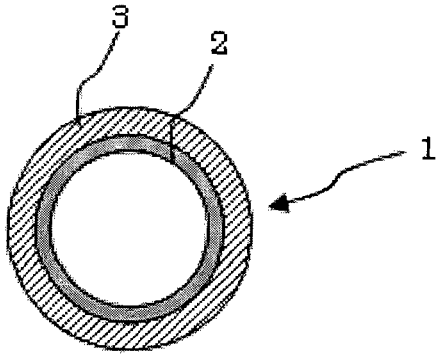
FIG. 1 is a cross-sectional view for explaining one example of a fixing roller, which is one embodiment of the elastic member of the present invention.

The elastic member of the present invention is an elastic member for use in an image forming apparatus, and contains at least a base, and an elastic layer provided on the base, and may further contain other layers, if necessary.

A shape of the elastic member is appropriately selected depending on the intended purpose without any limitation, and examples thereof include a sheet-shape, a film-shape, a roll-shape, and a belt-shape.

Use of the elastic member is appropriately selected depending on the intended purpose without any limitation, and examples thereof include a rotation body.

The rotation body is appropriately selected depending on the intended purpose without any limitation, and examples thereof include a fixing roller, and a fixing belt.

Martens hardness of the elastic member is appropriately selected depending on the intended purpose without any limitation, but it is preferably 0.1 $N/mm^2$ to 1.0 $N/mm^2$.

Examples of a method for measuring the hardness include a method using a microhardness tester.

The elastic work rate of the elastic member is appropriately selected depending on the intended purpose without any limitation, but it is preferably 80% or greater.

Examples of a method for measuring the elastic work rate include a method using a microhardness tester.

Note that, the elastic work rate typically indicates how much energy can be released relative to the pressure applied to a material, as the pressure is removed. The higher value of the elastic work rate means the higher ability for releasing the energy. Accordingly, as the elastic work rate increases, less likely to maintain the physical stress as permanent strain, relative to the physical stress applied to the material. Therefore, such material is a material having excellent scratch resistance, and abrasion resistance.

<Elastic Layer>

The elastic layer contains a polymer having a structure derived from terpene and a structure where a main chain contains a silicon atom, and may further contain other components, if necessary.

The average thickness of the elastic layer is appropriately selected depending on the intended purpose without any limitation, but it is preferably 100 μm to 5 mm, more preferably 100 μm to 3 mm, and even more preferably 150 μm to 2 mm. When the average thickness thereof is less than 100 μm, durability of an elastic member may be lowered, or a resulting fixing member may have low responsiveness to surface irregularities of a recording medium. When the average thickness thereof is greater than 5 mm, transmittance of heat may be poor, which may lead to low fixing ability.

An elastic work rate of the elastic layer is appropriately selected depending on the intended purpose without any limitation, but it is preferably 80% or greater.

Examples of a measuring method of the average thickness include a method containing randomly selecting 10 points per 10 $cm^2$ of the elastic layer, measuring a thickness at the selected 10 points, and calculating the average thickness from the thicknesses measured at the 10 points.

Examples of a device used for the measurement of the average thickness include a micrometer.

<<Polymer Having Structure Derived From Terpene and Structure Where Main Chain Contains Silicon Atom>>

The polymer having a structure derived from terpene and a structure where a main chain contains a silicon atom is appropriately selected depending on the intended purpose without any limitation.

A production method of the polymer having a structure derived from terpene and a structure where a main chain contains a silicon atom is appropriately selected depending on the intended purpose without any limitation, and examples thereof include: a method containing mixing a polymer having a structure where a main chain contains a silicon atom with terpene; and a method containing crosslinking a polymer having a structure where a main chain contains a silicon atom with terpene. The conditions for the crosslinking are appropriately selected without any limitation depending on the intended purpose and the materials used. Preferably, the polymer and terpene are mixed together, and then are heated at 100° C. to 180° C. for 5 minutes to 30 minutes.

Examples of an analysis method of the polymer having a structure derived from terpene and a structure in which a main chain contains a silicon atom, include $^1$H-NMR.

Examples of a method for measuring an amount of the structure derived from terpene relative to the polymer having a structure derived from terpene and a structure in which a main chain contains a silicon atom include $^1$H-NMR.

—Polymer Having Structure Where Main Chain Contains Silicon Atom—

The polymer having a structure where a main chain contains a silicon atom generally means a polymer, such as polysiloxane, or polysilane. As for such polymer for use in the elastic member of the present invention, polysiloxane is suitably used. Moreover, polysiloxane is typically heat resistant rubber having better heat resistance than those of diene rubber and urethane rubber.

—Heat Resistant Rubber—

The heat resistant rubber typically means rubber which is not modified by heating up to approximately 200° C.

The heat resistant rubber is appropriately selected depending on the intended purpose without any limitation, and examples thereof include silicone rubber, fluorocarbonsiloxane rubber, and fluorosilicone rubber. These may be used alone, or in combination. Note that, the heat resistant rubber optionally contains, for example, filler, a reinforcing agent, an electroconductivity controlling agent, an antioxidant, a colorant, a plasticizer, wax, or oil.

—Silicone Rubber—

The silicone rubber is appropriately selected depending on the intended purpose without any limitation, provided that it is rubber having a siloxane structure and examples thereof include silicone rubber having a constitutional unit represented by the following general formula (1).

General Formula (1)

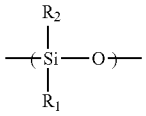

In the general formula (1), $R_1$ and $R_2$ are each an unsubstituted or substituted monovalent hydrocarbon group, and may be identical or different. Moreover, carbon numbers of each of $R_1$ and $R_2$ is appropriately selected depending on the intended purpose without any limitation, but it is preferably 1 to 8. $R_1$ and $R_2$ each having carbon atoms of 1 to 8 are appropriately selected depending on the intended purpose without any limitation, and examples thereof include an alkyl group, a cycloalkyl group, and an aryl group. Among them, preferred are a methyl group, an ethyl group, and a phenyl group.

Moreover, the silicone rubber may contain a vinyl group.

The vinyl group may be bonded to a terminal of a molecule of the silicone rubber, or bonded to a side chain of a molecule of the silicone rubber. In the case where the vinyl group is bonded to a side chain of the silicon rubber molecule, the vinyl group may be bonded to a side chain of a constitutional unit other than the one represented by the general formula (1).

The number of the vinyl groups per molecule of the silicone rubber is appropriately selected depending on the intended purpose without any limitation, but it is preferably 2 or more.

Examples of an analysis method for the number of the vinyl groups contained include $^1$H-NMR.

The weight average molecular weight of the silicone rubber is appropriately selected depending on the intended purpose without any limitation, but it is preferably 1,000 to 1,000,000.

A commercial product of the silicone rubber is appropriately selected depending on the intended purpose without any limitation, and examples thereof include KE1950-40 (manufactured by Shin-Etsu Chemical Co., Ltd.), and DY35-2083 (manufactured by Dow Corning Toray Co., Ltd.).

—Fluorocarbonsiloxane Rubber—

The fluorocarbonsiloxane rubber is appropriately selected depending on the intended purpose without any limitation, provided that it is rubber having a fluorocarbonsiloxane structure, and examples thereof include fluorocarbonsiloxane rubber having a constitutional unit represented by the following general formula (2).

General Formula (2)

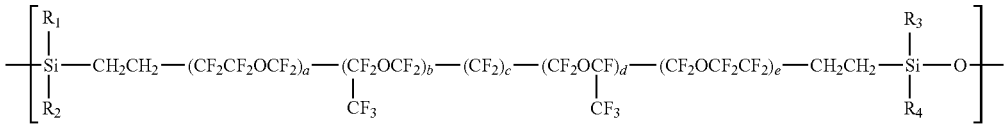

In the general formula (2), $R_1$ to $R_4$ are each an unsubstituted or substituted monovalent hydrocarbon group, and may be identical or different. Moreover, the number of carbon atoms contained in each of $R_1$ to $R_4$ is appropriately selected depending on the intended purpose without any limitation, but it is preferably 1 to 8. $R_1$ to $R_4$ each having carbon atoms of 1 to 8 are is appropriately selected depending on the intended purpose without any limitation, and examples thereof include an alkyl group, a cycloalkyl group, and an aryl group. In the general formula (2), a and e are each independently an integer of 0 to 1, b and d are each independently an integer of 1 to 4, and c is an integer of 0 to 8.

Moreover, the fluorocarbonsiloxane rubber may contain a vinyl group.

The vinyl group may be bonded to a terminal of a molecule of the fluorocarbonsiloxane rubber, or bonded to a side chain of a molecule of the fluorocarbonsiloxane rubber. In the case where the vinyl group is bonded to a side chain of a molecule of the fluorocarbonsiloxane rubber, the vinyl group may be bonded to a side chain of a constitutional unit other than that represented by the general formula (2).

The number of the vinyl groups per molecule of the fluorocarbonsiloxane rubber is appropriately selected depending on the intended purpose without any limitation, but it is preferably 2 or more.

Examples of an analysis method for the number of the vinyl groups contained include $^1$H-NMR.

The weight average molecular weight of the fluorocarbonsiloxane rubber is appropriately selected depending on the intended purpose without any limitation, but it is preferably 1,000 to 100,000.

A commercial product of the fluorocarbonsiloxane rubber is appropriately selected depending on the intended purpose without any limitation, and examples thereof include SIFEL3400 (manufactured by Shin-Etsu Chemical Co., Ltd.).

—Fluorosilicone Rubber—

The fluorosilicone rubber is appropriately selected depending on the intended purpose without any limitation, provided that it is a fluorosilicone rubber having a constitutional unit represented by the following general formula (3).

General Formula (3)

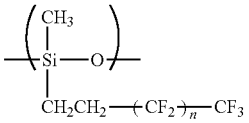

In the general formula (3), n is an integer of 0 to 20.

Moreover, the fluorosilicone rubber may have a vinyl group.

The vinyl group may be bonded to a terminal of a molecular chain of the fluorosilicone rubber, or may be bonded to a side chain of a molecule of the fluorosilicone rubber. In the case where the vinyl group is bonded to a side chain of a molecule of the fluorosilicone rubber, the vinyl group may be bonded to a side chain of a constitutional unit other than that represented by the general formula (3).

The number of the vinyl groups per molecule of the fluorosilicone rubber is appropriately selected depending on the intended purpose without any limitation, but it is preferably 2 or more.

Examples of an analysis method for the number of the vinyl groups contained include $^1$H-NMR.

The weight average molecular weight of the fluorosilicone rubber is appropriately selected depending on the intended purpose without any limitation, but it is preferably 1,000 to 1,000,000.

A commercial product of the fluorosilicone rubber is appropriately selected depending on the intended purpose without any limitation, and examples thereof include X36-420 (manufactured by Shin-Etsu Chemical Co., Ltd.), FSE7540 (manufactured by Momentive Performance Materials Inc.), FSL7641 (manufactured by Momentive Performance Materials Inc.), and SE-1541-U (manufactured by Dow Corning Toray Co., Ltd.).

—Terpene—

The terpene is typically hydrocarbon having isoprene as a constitutional unit, and is a biological material generated by plants, insects, or fungus. The terpene is originally a name given to a group of C10 compounds found in a large amount in essential oil, and therefore the terpene is systematized with C10 as a standard. Depending on the classification, among the terpenes, a derivative having a functional group, such as a carbonyl group, and a hydroxyl group, is called terpenoid.

Moreover, the terpene is widely present in the nature, but examples of the terpene, which can be stably obtained with a large quantity, as a industrial raw material, include pine oil (turpentine oil), and oil contained in skins of citrus fruits, such as orange, (orange oil). Industrially, the terpene is used as a raw material of fragrance, a modifying agent of rubber and plastics, an additive for coating materials, and building materials. The structure of the terpene is very similar to natural rubber (polyisoprene) or a styrene monomer, and has high affinity to these materials. Because of high affinity, the terpene is widely used as a softening agent of rubber, or a solvent of a styrene resin.

The terpene is appropriately selected depending on the intended purpose without any limitation, but it is preferably terpene having two or more unsaturated carbon bonds.

The terpene having two or more unsaturated carbon bonds is appropriately selected depending on the intended purpose without any limitation, and examples thereof include limonene, myrcene, squalene, and lycopene. Among them, limonene is preferable in view of an obtainable effect as a softening agent, and durability. These may be used alone, or in combination. A mixing rate of a plurality of the compounds is appropriately selected depending on the intended purpose without any limitation, provided that it does not adversely affect the obtainable effect. Note that, the limonene has a six-membered ring structure to which two isoprene molecules are bonded, and has two unsaturated carbon bonds.

An amount of the terpene to be added relative to 100 parts by mass of the polymer having a structure where a main chain contains a silicon atom is appropriately selected depending on the intended purpose without any limitation, but it is preferably 0.1 parts by mass to 10 parts by mass, more preferably 0.5 parts by mass to 5 parts by mass, and even more preferably 1.0 part by mass to 4 parts by mass. When the amount thereof is smaller than 0.1 parts by mass, a softening effect may not be attained. When the amount thereof is greater than 10 parts by mass, hardness may be excessively decreased to impair durability of an elastic member.

Examples of a production method of the elastic layer include a method containing mixing the polymer having a structure where a main chain contains a silicon atom, with the terpene to prepare a mixed liquid, and applying the mixed liquid or dip coating with the mixed liquid.

<Base>

The base is appropriately selected depending on the intended purpose without any limitation, but it is preferably a heat resistant base.

The heat resistant base is appropriately selected depending on the intended purpose without any limitation, and examples thereof include a resin, a metal, a ceramic, and glass.

—Resin—

The resin is appropriately selected depending on the intended purpose without any limitation, and examples thereof include polyimide, polyamide imide, polyether ether ketone (PEEK), polyether sulfone (PES), polyphenylene sulfide (PPS), and a fluororesin.

As for the resin, moreover, any of the above-listed resins, in which magnetic electroconductive particles are dispersed, may be used. Specifically, the magnetic electroconductive particles are dispersed in a resin material of a varnish state by means of a disperser, such as a roll mill, a sand mill, and a centrifugal defoaming device. The resultant is adjusted to have an appropriate viscosity using a solvent, followed by molded in a mold to give the predetermined thickness.

—Metal—

The metal is appropriately selected depending on the intended purpose without any limitation, and examples thereof include nickel, iron, chromium, aluminum, copper, and zinc. Moreover, the metal may be alloy of the above-listed metals. Further, the metal itself may have a heat generating function.

The alloy is appropriately selected depending on the intended purpose without any limitation, and examples thereof include stainless steel and brass.

—Shape etc., of Base—

A shape of the base is appropriately selected depending on the intended purpose without any limitation, and examples thereof include a plate shape, a belt shape, and a cylindrical shape.

A structure of the base is appropriately selected depending on the intended purpose without any limitation, and it may be a single layer structure, or a laminate structure.

The average thickness of the base is appropriately selected depending on the intended purpose without any limitation, but it is preferably 30 μm to 500 μm, more preferably 50 μm to 150 μm, in view of thermal capacity and strength. In the case where the base is a metal, the thickness of the base is preferably 100 μm or less in view of flexibility of a resulting fixing belt.

In the case where the base is the metal, the desirable Curie point can be attained by adjusting an amount of each material, and processing conditions. By forming a base that functions a heat generating layer using a magnetic electroconductive material having a Curie point around the fixing temperature, the heat generating layer can be heated by electromagnetic induction without over heating.

<Other Layers>

Other layers are appropriately selected depending on the intended purpose without any limitation, and examples thereof include a primer layer.

—Primer Layer—

The primer layer is appropriately selected depending on the intended purpose without any limitation, provided that it enhances the adhesion force between the elastic layer and the base, and examples thereof include a silane coupling agent, and a silicone-based adhesive.

(Fixing Member)

The fixing member of the present invention contains the elastic member of the present invention, and may further contain other members, if necessary.

Use of the fixing member is appropriately selected depending on the intended purpose without any limitation, and examples thereof include a fixing belt and a fixing roller, which are configured to fix a toner image on a recording medium.

FIG. 1 is a cross-sectional view for explaining one example of a fixing roller, which is one embodiment of the elastic member of the present invention.

The fixing roller 1 depicted in FIG. 1 contains an elastic layer 3 containing the polymer having a structure derived from terpene and a structure where a main chain contains a silicon atom, formed on a core bar 2 serving as the base. Note that, a method for forming the elastic layer 3 on the core bar 2 is appropriately selected depending on the intended purpose without any limitation, and examples thereof include a method containing providing a core bar 2, to which a primer layer has been formed, in a mold, applying a liquid containing heat resistant rubber and terpene into the mold, and heating.

Figure 2:
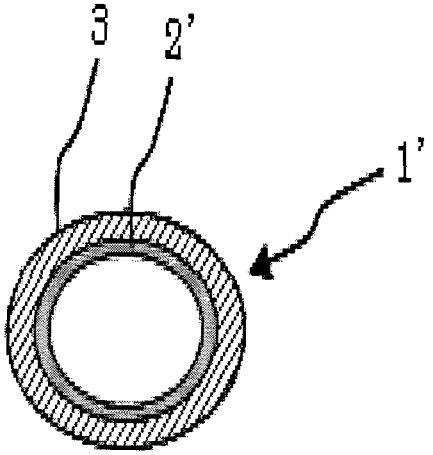
FIG. 2 is a cross-sectional view for explaining one example of a fixing belt, which is one embodiment of the elastic member of the present invention.

FIG. 2 is a cross-sectional view for explaining one example of a fixing belt, which is one embodiment of the elastic member of the present invention.

The fixing belt 1' depicted in FIG. 2 has the same structure to that of the fixing roller 1, provided that the core bar 2, which is a rigid member, is replaced with a flexible base 2'. Note that, a method for forming the flexible base 2' on the elastic layer 3 is not particularly limited, and examples thereof include a method containing applying a liquid containing heat resistant rubber and terpene onto the base 2', on which a primer layer has been formed, followed by heating.

In the descriptions above, the fixing roller and the fixing belt are described as examples of the elastic member, but these may be used in the other forms, such as a sheet, and a film.

(Fixing Device)

The fixing device of the present invention contains the fixing member of the present invention, and may further contain other members, if necessary.

The aforementioned other members are appropriately selected depending on the intended purpose without any limitation, and examples thereof include a heat roller, a pressure roller, a halogen heater, a tension roller, and a thermistor.

Figure 3:
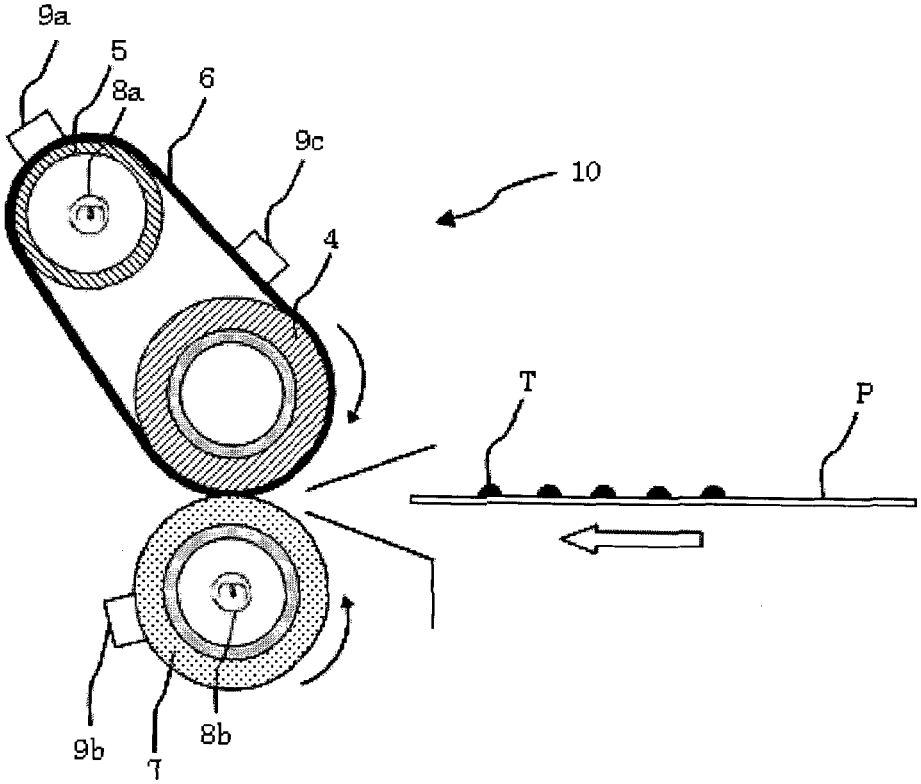
FIG. 3 is a cross-sectional view for explaining one example of the fixing device of the present invention.

FIG. 3 is a cross-sectional view for explaining one example of the fixing device of the present invention.

The belt-fixing device 10 depicted in FIG. 3 has a structure, in which a fixing roller 4 containing a metal pipe serving as the core bar, and an elastic layer composed of heat resistant rubber and terpene and formed on the surface of the metal pipe, and a heat roller 5 containing a metal pipe and a first halogen heater 8*a* disposed inside the metal pipe are provided; a fixing belt 6, on which an elastic layer has been formed via primer, is supported with these rollers; and the fixing roller 4 is in contact with the pressure roller 7 via the fixing belt 6 with pressure. The pressure roller 7 has a structure where the elastic layer composed of heat resistant rubber is provided on a surface of the metal pipe, and a second halogen heater 8*b* is provided inside the metal pipe.

The fixing belt 6 is held around the heat roller 5 and the fixing roller 4 without flexion by pushing the heat roller 5 to be away from the fixing roller 4, or further providing a tension roller (not illustrated). The surface temperature of the heat roller 4 and the pressure roller 7 is detected by the thermistors 9*a* and 9*b*, and controlled to be the predetermined set temperature. Moreover, the temperature of the fixing belt 6 held between the fixing roller 4 and the heat roller 5 can be detected by the thermistor 9*c*.

The toner T transferred onto the recording medium. P is fixed by the belt-fixing device 10.

(Image Forming Apparatus)

The image forming apparatus of the present invention contains at least a photoconductor, a charging unit, an exposing unit, a developing unit, a transferring unit, and a fixing unit, and may further contain other units.

Note that, the fixing unit is the fixing device of the present invention.

<Photoconductor>

The photoconductor is appropriately selected depending on the intended purpose without any limitation, and examples thereof include an inorganic photoconductor, and an organic photoconductor. A shape, structure, and size of the photoconductor are appropriately selected depending on the intended purpose without any limitation, but the shape thereof is preferably a drum shape.

—Inorganic Photoconductor—

The inorganic photoconductor is appropriately selected depending on the intended purpose without any limitation, and examples thereof include amorphous silicon, and selenium. Among them, amorphous silicon is preferable in view of its long service life.

—Organic Photoconductor—

The organic photoconductor is appropriately selected depending on the intended purpose without any limitation, and examples thereof include polysilane, and phthalopolymethine.

<Charging Unit>

The charging unit is appropriately selected depending on the intended purpose without any limitation, provided that it is a unit configured to charge a surface of the photoconductor, but it is preferably a charger.

—Charger—

The charger is appropriately selected depending on the intended purpose without any limitation, and examples thereof include a contact charger, and a non-contact charger.

The contact charger, is appropriately selected depending on the intended purpose without any limitation, and examples thereof include an electroconductive or semiconductive roller, brush, film, and rubber blade.

The non-contact charger is appropriately selected depending on the intended purpose without any limitation, and examples thereof include a charger utilizing corona discharge, such as corotron and scorotron.

<Exposing Unit>

The exposing unit is appropriately selected depending on the intended purpose without any limitation, provided that it is a unit configured to expose the charged surface of the photoconductor to light to form a latent electrostatic image, but it is preferably an exposure device.

—Exposure Device—

The exposure device is appropriately selected depending on the intended purpose without any limitation, provided that it is capable of performing imagewise exposure corresponding to an image to be formed on the surface of the photoconductor, which has been charged by the charger, and examples thereof include a reproduction optical exposing device, a rod-lens array exposing device, a laser optical exposure device, and a liquid crystal shutter optical device.

Note that, in the present invention, a back light exposure system may be employed. The back light exposure system is the exposure system where exposure is performed imagewise from the back surface of the electrophotographic photoconductor.

<Developing Unit>

The developing unit is appropriately selected depending on the intended purpose without any limitation, provided that it is a unit configured to develop the latent electrostatic image on the photoconductor with a toner to form a toner image, but it is preferably a unit housing the toner or developer therein, and containing at least a developing device capable of applying the toner or developer to the latent electrostatic image in a contact or non-contact manner.

—Developing Device—

The developing device is appropriately selected depending on the intended purpose without any limitation, but it is preferably a developing device containing a stirrer configured to stir the toner or developer to charge the toner or developer by friction, and a rotatable magnet roller. The developing device may be of a dry developing system, or of a wet developing system. Moreover, the developing device may be a developing device for a single color, or a developing device for multiple colors.

In the developing device, typically, the toner and a carrier are mixed and stirred to charge the toner due to the friction as caused, and the charged toner is held on a surface of the rotating magnet roller in the form of a brush to form a magnetic brush. As the magnet roller is provided adjacent to the photoconductor, part of the toner constituting the magnetic brush formed on the magnet roller is moved onto a surface of the photoconductor by electrical attraction force. As a result, the latent electrostatic image is developed with the toner to form a visible image formed of the toner on the surface of the photoconductor.

The developer housed in the developing device is appropriately selected depending on the intended purpose without any limitation, provided that it is a developer containing the toner. Note that, the developer may be a one-component developer, or a two-component developer.

<Transferring Unit>

The transferring unit is appropriately selected depending on the intended purpose without any limitation, provided that it is a unit configured to transfer the toner image formed on the photoconductor to a recording medium, but it is preferably a transfer unit containing a primary transferring unit configured to transfer toner images onto an intermediate transfer member to form a composite transfer image, and a secondary transferring unit configured to transfer the composite transfer image to a recording medium.

The intermediate transfer member is appropriately selected from conventional transfer members depending on the intended purpose without any limitation, and examples thereof include a transfer belt.

The transferring unit (the primary transferring unit, and the secondary transferring unit) is appropriately selected from conventional transfer devices depending on the intended purpose without any limitation, but it is preferably a transferring unit contains at least a transfer device configured to charge and separate the toner image formed on the photoconductor to the side of the recording medium. The transferring units may be used alone, or in combination.

—Transfer Device—

The transfer device is appropriately selected depending on the intended purpose without any limitation, and examples thereof include a corona transfer device, a transfer belt, a (pressure) transfer roller, and adhesion transfer device.

The recording medium is appropriately selected depending on the intended purpose without any limitation, and examples thereof include conventional recording mediums.

<Fixing Unit>

The fixing unit is appropriately selected depending on the intended purpose without any limitation, provided that it is a unit configured to fix the transferred toner image onto the recording medium and is the fixing device of the present invention. For example, the fixing unit may perform fixing every time an image formed of the toner of each color is transferred to the recording medium, or perform fixing once in the state where toner images of toners of multiple colors are laminated.

<Other Units>

The aforementioned other units are appropriately selected other units, and examples thereof include a diselectrification unit, a cleaning unit, a recycling unit, and a controlling unit.

—Diselectrification Unit—

The diselectrification unit is appropriately selected depending on the intended purpose without any limitation, provided that it is capable of applying electrification bias to the photoconductor, and examples thereof include conventional diselectrification device.

—Cleaning Unit—

The cleaning unit is appropriately selected depending on the intended purpose without any limitation, provided that it is capable of removing the toner remained on the photoconductor, and examples thereof include a magnetic brush cleaner, an electrostatic brush cleaner, a magnetic roller cleaner, a blade cleaner, a brush cleaner, and a web cleaner.

—Recycling Unit—

The recycling unit is appropriately selected depending on the intended purpose without any limitation, and examples thereof include conventional conveying units.

—Controlling Unit—

The controlling unit is appropriately selected depending on the intended purpose without any limitation, provided that it is capable of controlling the operation of each unit, and examples thereof include devices, such as a sequencer, and a computer.

Figure 4:
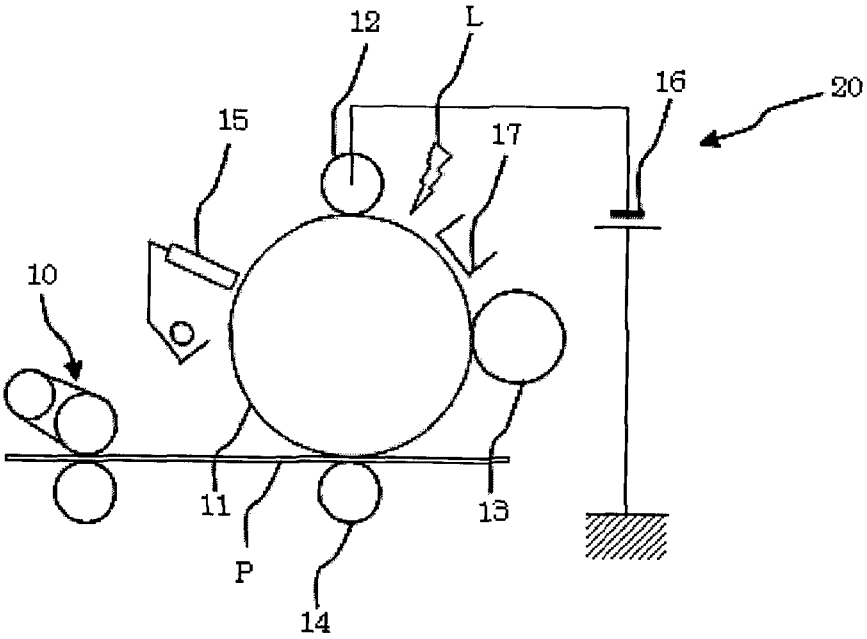
FIG. 4 is a schematic diagram for explaining one example of the image forming apparatus of the present invention.

FIG. 4 is a schematic diagram for explaining one example of the image forming apparatus of the present invention.

Note that, the same structure of FIG. 4 to that of FIG. 3 is provided with the same reference number, and explanation of which is emitted.

The image forming apparatus 20 of FIG. 4 contains: a belt-fixing device 10; a photoconductor drum 11; a charging roller 12 configured to be in contact with, and to charge the photoconductor drum 11; an exposure device (not illustrated) configured to apply laser light L to the charged photoconductor drum 11 to form a latent electrostatic image; a developing roller 13 configured to develop the latent electrostatic image formed on the photoconductor drum 11 with a toner to form a toner image; a transfer roller 14 configured to transfer the toner image formed on the photoconductor drum 11 to a recording medium P; and a cleaning device 15 configured to clean the photoconductor 11, from which the toner image has been transferred. Moreover, the image forming apparatus 20 contains a power source 16 configured to apply DC voltage to the charging roller 12, and a surface electrostatic voltmeter 17 configured to measure surface potential of the photoconductor drum 11.

Next, a method for forming an image by means of the image forming apparatus 20 is explained. First, a photoconductive layer (not illustrated) formed on the photoconductor drum 11 is uniformly charged by means of the charging roller 12, while rotating the photoconductor drum 11. Secondly, laser light L is applied to the charged photoconductive layer by the exposure device to form a latent electrostatic image. Thirdly, a toner is applied to the latent electrostatic image formed in the photosensitive layer by the developing roller 13 to develop the latent electrostatic image with the toner, to thereby form a toner image. Fourthly, the toner image formed on the photosensitive layer is transferred to a recording medium by means of the transfer roller 14. Lastly, the transferred toner image on the recording medium is fixed onto the recording medium by means of the belt-fixing device 10.

EXAMPLES

The present invention will be explained through Examples thereinafter, but Examples shall not be construed as to limit the scope of the present invention.

Example 1

After applying a primer for silicone rubber (product name: DY39-067, manufactured by Dow Corning Toray Co., Ltd.) onto a surface of a polyimide seamless belt (base) having an inner diameter of 60 mm, a width of 400 mm, and the average thickness of 0.1 mm, the resultant was air dried for 30 munities at room temperature, followed by heated for 30 minutes at 150° C. The obtained seamless belt was fixed around a mandrel, and in this state, the seamless belt was immersed in a liquid mixture obtained by adding 3 parts by mass of limonene to 100 parts by mass of a silicone rubber compound (product name: DY35-2083, manufactured by Dow Corning Toray Co., Ltd.), so that a coating liquid layer was formed by dipping. The resultant was then heated for 10 minutes at 150° C., followed by releasing the seamless belt from the mandrel. Then, the belt was heated for 4 hours at 200° C. so that a fixing belt was formed by forming, on the base, an elastic layer having the 10 points average thickness of 200 μm per 10 $cm^2$ of the fixing belt. Note that, the 10 points average thickness was measured by means of a micrometer (product name: Soft Touch Micro CLM, manufactured by Mitutoyo Corporation).

Example 2

A fixing belt of Example 2 was prepared in the same manner as in Example 1, provided that the amount of the limonene was changed to 0.1 parts by mass. Note that, -the elastic layer of Example 2 had the 10 points average thickness of 210 μm per 10 $cm^2$ of the fixing belt.

Example 3

A fixing belt of Example 3 was prepared in the same manner as in Example 1, provided that the amount of the limonene was changed to 5 parts by mass. Note that, the elastic layer of Example 3 had the 10 points average thickness of 205 μm per 10 $cm^2$ of the fixing belt.

Example 4

A fixing belt of Example 4 was prepared in the same manner as in Example 1, provided that the amount of the limonene was changed to 10 parts by mass. Note that, the elastic layer of Example 4 had the 10 points average thickness of 190 μm per 10 $cm^2$ of the fixing belt.

Example 5

A fixing belt of Example 5 was prepared in the same manner as in Example 1, provided that 3 parts by mass of β-myrcene was added instead of the limonene. Note that, the elastic layer of Example 5 had the 10 points average thickness of 200 μm per 10 $cm^2$ of the fixing belt.

Example 6

A fixing belt of Example 6 was prepared in the same manner as in Example 1, provided that 3 parts of squalene was added instead of the limonene. Note that, the elastic layer of Example 6 had the 10 points average thickness of 200 μm per 10 $cm^2$ of the fixing belt.

Example 7

A fixing belt of Example 7 was prepared in the same manner as in Example 1, provided that the primer for silicone rubber and the silicon rubber compound were respectively replaced with primer for a fluororesin (product name: Primer, manufactured by Shin-Etsu Chemical Co., Ltd.), and a fluorocarbonsiloxane rubber compound (product name: SIFEL3400, manufactured by Shin-Etsu Chemical Co., Ltd.). Note that, the elastic layer of Example 7 had the 10 points average thickness of 195 μm per 10 $cm^2$ of the fixing belt.

Comparative Example 1

A fixing belt of Comparative Example 1 was prepared in the same manner as in Example 1, provided that the limonene was not added. Note that, the elastic layer of Comparative Example 1 had the 10 points average thickness of 200 μm per 10 $cm^2$ of the fixing belt.

Comparative Example 2

A fixing belt of Comparative Example 2 was prepared in the same manner as in Example 1, provided that instead of the limonene, 5 parts by mass of silicone oil (product name: KF-96-100cs, manufactured by Shin-Etsu Chemical Co., Ltd.) was added to 100 parts by mass of a silicone rubber compound (product name: KE-1950-40, manufactured by Shin-Etsu Chemical Co., Ltd.). Note that, the elastic layer of Comparative Example 2 had the 10 points average thickness of 200 μm per 10 $cm^2$ of the fixing belt.

<Surface Hardness of Fixing Member>

The Martens hardness and elastic work rate of the obtained fixing belt were measured by means of microhardness tester (product name: FISCHERSCOPE H100, manufactured by Helmut Fischer). Note that, the conditions for the measurement were as follows.

<<Measuring Conditions>>

Temperature: 25° C. (room temperature) Indenter: Vickers indenter (quadrangular pyramid having an angle of 136 degrees between the opposite faces)

Load: 50 mN max.

Indentation depth: 20 μm max.

Load profile: after increasing the load from 0 mN to 50 mN over 10 seconds (pushing), the load was maintained for 10 seconds, followed by decreasing the load from 50 mN to 0 mN over 10 seconds (pulling out).

The results from the measurement are depicted in Table 1.

TABLE 1

| | Surface hardness of fixing member | |
|---|---|---|
| | Martens hardness ($N/mm^2$) | Elastic work rate (%) |
| Ex. 1 | 0.34 | 85 |
| Ex. 2 | 0.37 | 87 |
| Ex. 3 | 0.29 | 84 |
| Ex. 4 | 0.18 | 78 |
| Ex. 5 | 0.35 | 86 |
| Ex. 6 | 0.36 | 86 |
| Ex. 7 | 0.32 | 87 |
| Comp. Ex. 1 | 0.39 | 88 |
| Comp. Ex. 2 | 0.25 | 69 |

The fixing belts of Examples 1 to 7 had smaller Martens hardness compared to that of the fixing belt of Comparative Example 1. It was found that the elastic work rates of the fixing belts of Examples 1 to 7 were hardly affected by the terpene, although the hardness thereof reduced due to the addition of the terpene. On the other hand, the fixing belt of Comparative Example 2 reduced its hardness, but the elastic work rate thereof was also reduced. The reason for this is not clear, but it is assumed that part of the unsaturated bond of the terpene is crosslinked, similar to a vinyl group of the polymer, and therefore the terpene acts as a low molecule softening agent, but increases an apparent crosslink density so that the elastic work rate of the fixing belt can be maintained.

<Evaluation Method of Fixing Member>

The evaluation conditions are as follows.

<<Evaluation Condition>>

Photocopier: RICOH IMAGIO MP C2500 Document for copying: solid image (cyan, 600 dpi, imaging area of 100%)

Copying mode: full color, one side printing

Recording medium: full color PPC sheet TYPE6000, size: A4, vertical cut (manufactured by Ricoh Company Limited)

Toner: IMAGIO SPOT TONER C3000 (cyan, manufactured by Ricoh Company Limited)

A fixing belt of RICOH IMAGIO MP C2500 (manufactured by Ricoh Company Limited) was replaced with each of the fixing belts obtained in Examples 1 to 8 and Comparative Examples 1 to 2, and printing was performed under the aforementioned conditions.

<Evaluation on Image Quality of Fixed Image>

A presence of unevenness in gloss on an image formed on the 1,000th sheet output under the evaluation condition was visually observed. A level at which there was hardly any unevenness in gloss was judged as "A," a level at which unevenness in gloss was slightly observed but there was no problem in practical use was judged as "B," and a level at which unevenness in gloss was observed and there was a problem in practical use was judged as "C."

The evaluation results are depicted in Table 2.

<Evaluation on Durability of Belt>

After the evaluation on the image quality of the fixed image, a surface of the belt was visually observed whether there was any defect, such as scratch, and abrasion. A level at which there was hardly any defect was judged as "A," a level at which a defect was slightly observed but there was no problem on practical use was judged as "B," and a level at which a defect was observed and there was a problem on practical use was judged as "C."

The evaluation results are depicted in Table 2.

TABLE 2

| | Evaluation of image quality of fixed image (after outputting 1,000 sheets) | Evaluation of durability of fixing belt (after outputting 1,000 sheets) |
|---|---|---|
| Ex. 1 | A | A |
| Ex. 2 | B | A |
| Ex. 3 | A | B |
| Ex. 4 | A | B |
| Ex. 5 | A | A |
| Ex. 6 | A | A |
| Ex. 7 | A | B |
| Comp. Ex. 1 | C | A |
| Comp. Ex. 2 | A | C |

The fixing belt of Comparative Example 1 formed the fixed image having a surface on which the unevenness in gloss was formed, and a level of which was that there was a problem on practical use, but there was no defect, such as scratch and abrasion on a surface of the fixing belt. This is probably because the fixing belt of Comparative Example had the higher Martens hardness and the higher elastic work rate than those of the fixing belts of Examples, and therefore the fixing belt of Comparative Example 1 is excellent in durability, but had insufficient responsiveness to surface irregularities.

Moreover, the fixing belt of Comparative Example 2 could form a uniform image without unevenness in gloss, but the fixing belt thereof was scratched in the circumferential direction at the area where edges of the sheets are touched, to the extend that a problem is cause on practical use. This is probably because the responsiveness to irregularity is improved due to the reduced rubber hardness upon the addition of the terpene, but the reduced elastic work rate of the rubber lead to deterioration in durability thereof, which caused scratches and abrasion on the surface of the fixing belt as the number of output sheets increased.

On the other hand, the fixing belts of Examples 1 to 7 could produce a uniform image without unevenness in gloss, even after outputting 1,000 sheets. Moreover, there were very few detects, such as scratches and abrasion, on a surface of the fixing belt. In Example 2, the amount of the terpene added was 0.1 parts by mass, which is small, and therefore the result thereof was slightly inferior to that of Example 1 on the evaluation of the gloss unevenness, but it was a level at which there was no problem on practical use. In Examples 3 and 4, the amounts of the terpene added were respectively 5 parts by mass, and 10 parts by mass, which were large, and therefore slightly more scratches and abrasion were formed on the surface of each fixing belt compared to that of Example 1, but it was a level at which there was not problem on practical use.

It was found from the results above, that the elastic layer could be softened without impairing the durability of the rubber by adding the polymer having a structure derived from terpene and a structure in which a main chain contain a silicon atom to the elastic layer, and therefore the elastic member, which improved responsiveness to surface irregularities of a recording medium, and was capable of outputting high quality fixed images without unevenness over a long period, could be provided.

The embodiments of the present invention are, for example, as follows:

<1> An elastic member for image forming apparatus, containing:

a base; and an elastic layer provided on the base, wherein the elastic layer contains a polymer having a structure derived from terpene and a structure where a main chain contains a silicon atom.

<2> The elastic member according to <1>, wherein the polymer is obtained by mixing a polymer having a structure where a main chain contains a silicon atom, with terpene.

<3> The elastic member according to <2>, wherein an amount of the terpene added for the mixing is 0.1 parts by mass to 10 parts by mass relative to 100 parts by mass of the polymer having a structure where a main chain contains a silicon atom.

<4> The elastic member according to any one of <1> to <3>, wherein the terpene contains two or more unsaturated carbon bonds.

<5> The elastic member according to any one of <1> to <4>, wherein the terpene is limonene.

<6> A fixing member containing:

the elastic member according to any one of <1> to <5>, wherein the fixing member is configured to fix a toner image on a recording medium.

<7> The fixing member according to <6>, wherein the fixing member is a fixing roller, a fixing belt, or a combination of the fixing roller and the fixing belt.

<8> A fixing device containing:

the fixing member according to <6> or <7>.

<9> An image forming apparatus containing:

a photoconductor;

a charging unit configured to charge the photoconductor;

an exposing unit configured to expose the charged photoconductor to light to form a latent electrostatic image;

a developing unit configured to develop the latent electrostatic image formed on the photoconductor with a toner to form a toner image;

a transferring unit configured to transfer the toner image formed on the photoconductor to a recording medium; and a fixing unit configured to fix the transferred toner image on the recording medium, wherein the fixing unit is the fixing device according to <8>.

REFERENCE SIGNS LIST

1: fixing roller
1': fixing belt
2: core bar
2': base
3: elastic layer
4: fixing roller
5: heat roller
6: fixing belt
7: pressure roller
8*a*, 8*b*: halogen heater
9*a*, 9*b*, 9*c*: thermistor
10: belt-fixing device
11: photoconductor drum
12: charging roller
13: developing roller
14: transfer roller

15: cleaning device
16: power source
17: surface electrostatic voltmeter
20: image forming apparatus
L: laser light
T: toner image
P: recording medium

The invention claimed is:

1. A fixing member comprising:
an elastic member for an image forming apparatus,
wherein the elastic member comprises
a base, and
an elastic layer provided on the base,
wherein the elastic layer comprises a polymer having a structure derived from terpene and a structure where a main chain comprises a silicon atom, and
wherein the fixing member is configured to fix a toner image on a recording medium.

2. The fixing member according to claim 1, wherein the polymer is obtained by mixing a polymer having a structure where a main chain comprises a silicon atom, with terpene.

3. The fixing member according to claim 2, wherein an amount of the terpene added for the mixing is 0.1 parts by mass to 10 parts by mass relative to 100 parts by mass of the polymer having a structure where a main chain comprises a silicon atom.

4. The fixing member according to claim 1, wherein the terpene comprises two or more unsaturated carbon bonds.

5. The fixing member according to claim 1, wherein the terpene is limonene.

6. The fixing member according to claim 1, wherein the fixing member is a fixing roller, a fixing belt, or a combination of the fixing roller and the fixing belt.

7. A fixing device comprising:
a fixing member
wherein the fixing member comprises an elastic member for an image forming apparatus,
wherein the elastic member comprises
a base, and
an elastic layer provided on the base, and
wherein the elastic layer comprises a polymer having a structure derived from terpene and a structure where a main chain comprises a silicon atom, and
wherein the fixing member is configured to fix a toner image on a recording medium.

* * * * *